US008603256B2

(12) United States Patent
Shuman et al.

(10) Patent No.: US 8,603,256 B2
(45) Date of Patent: Dec. 10, 2013

(54) MOBILE CONTAINER CLEANING SYSTEM

(75) Inventors: Bruce Shuman, Huntington Beach, CA (US); Jerry Moffatt, Huntington Beach, CA (US); Bruce Atwell, Mission Viejo, CA (US); Robert J. Romacly, Huntington Beach, CA (US); Glenn A. Romacly, Apple Valley, CA (US)

(73) Assignee: Rainbow Conversion Technologies, LLC, Huntington Beach, CA (US)

( * ) Notice: Subject to any disclaimer, the term of this patent is extended or adjusted under 35 U.S.C. 154(b) by 373 days.

(21) Appl. No.: 12/371,772

(22) Filed: Feb. 16, 2009

(65) Prior Publication Data

US 2010/0206331 A1 Aug. 19, 2010

(51) Int. Cl.

| | |
|---|---|
| ***B08B 7/00*** | (2006.01) |
| ***B08B 3/00*** | (2006.01) |
| ***B08B 9/08*** | (2006.01) |
| ***B08B 9/093*** | (2006.01) |

(52) U.S. Cl.

USPC ..... 134/22.18; 134/10; 134/23; 134/34; 134/104.2; 134/104.4; 134/110; 134/111; 134/135; 134/137; 134/155

(58) Field of Classification Search

USPC ..... 134/22.1, 22.18, 23, 34, 10, 104.2, 134/104.4, 110, 111, 135, 137, 155

See application file for complete search history.

(56) References Cited

U.S. PATENT DOCUMENTS

| | | | | |
|---|---|---|---|---|
| 3,324,866 | A | 6/1965 | Davis | |
| 3,291,144 | A | 12/1966 | Diamond | |
| 3,604,038 | A * | 9/1971 | Di Ilio | 15/56 |
| 4,211,745 | A * | 7/1980 | Boyd | 422/28 |
| 4,694,846 | A | 9/1987 | Bouchard | |
| 5,425,875 | A * | 6/1995 | Duperon | 210/159 |
| 6,336,239 | B1 * | 1/2002 | Cooper | 15/56 |
| 6,554,008 | B2 | 4/2003 | Dewey et al. | |
| 7,225,816 | B2 | 6/2007 | Byers | |
| 7,398,789 | B1 * | 7/2008 | Herrera | 134/166 R |
| 7,846,263 | B1 * | 12/2010 | Marcantel | 134/22.1 |
| 2008/0035176 | A1 * | 2/2008 | Byers | 134/22.1 |
| 2008/0089764 | A1 * | 4/2008 | Vistro | 414/408 |

FOREIGN PATENT DOCUMENTS

| | | | |
|---|---|---|---|
| DE | 3439776 | A1 * | 6/1985 |
| DE | 29615431 | U1 * | 10/1996 |
| EP | 628500 | A1 * | 12/1994 |

* cited by examiner

*Primary Examiner* — Alexander Markoff

(74) *Attorney, Agent, or Firm* — Hackler Daghighian & Martino

(57) ABSTRACT

A movable trash container cleaning system includes a vehicle with a spray booth and a movable access door for enclosing the spray booth. A manipulating arm is provided for engaging and lifting a container disposed outside a vehicle and inverting a container inside the spray booth. A sprayer is provided and disposed for spraying the fluid onto inside surfaces of the inverted container to clean the container and dislodge the solids. A stationary platform is provided for receiving the dislodge solids wash from the inverted container and the ram packer moves to dislodge the solids from the platform into a storage chamber in the vehicle.

5 Claims, 3 Drawing Sheets

MOBILE CONTAINER CLEANING SYSTEM

The present invention generally relates to sanitizing systems for waste containers and is more particularly directed to a mobile system for onsite cleaning of emptied containers.

The handling of residential and commercial waste containers is often performed through the use of an automated collection truck that engages the container and lifts it to dump its contents into a contained refuse again aboard the truck.

After a period of time, the trash containers normally collect wastes which depends upon the nature of the trash deposited in the container.

It is apparent that unless this residue is cleaned from the container, it continues to accumulate and may become a potential health hazard.

It should also be appreciated that the large size of the trash containers typically utilized in both residential and commercial areas provides problem for the cleaning thereof.

While an operator can utilize a hand held spray gun to clean the container, this operation is time consuming and further may present health problems.

Systems have been developed for inverting a trash container over a spray nozzle, however these systems are not contained and thus spray airborne from the powerful spray nozzles enters into the atmosphere carrying unknown contaminants.

The present invention provides for a mobile trash container cleaning system which provides for cleaning of trash containers in a closed compartment and further handling of solids washed from the container by compaction thus enabling a greater number of containers to be washed during a single excursion of the mobile cleaning system.

SUMMARY OF THE INVENTION

A mobile trash container cleaning system in accordance with the present invention generally includes a vehicle along with a spray booth disposed on the vehicle.

A movable access door is provided for enclosing the spray booth and a manipulating arm is provided for engaging and lifting a container disposed outside a vehicle and inverting the container inside the spray booth.

A sprayer disposed for spraying fluid onto inside surfaces of the inverted container is provided to clean the container and dislodge solids.

A stationary platform receives a dislodged solids washed from the inverted container and a ram packer moves the dislodged solids from the platform and into a storage chamber within the vehicle.

More particularly, a system in accordance with the present invention provides for a platform which includes perforations enabling the sprayed fluid to pass therethrough.

A ramp disposed in the spray booth beneath the inverted container enables the direction of dislodged solids and spray fluids onto the platform.

A sprayed fluid capturing apparatus is disposed, in part, under the platform, for storage on the vehicle or reuse in spraying waste containers.

A movable panel is also provided for covering a stationary platform during operation of the ram packer to more efficiency transfer the dislodged and compacted solids into a storage chamber within the vehicle.

A method in accordance with the present invention for cleaning a trash container generally includes picking up a container outside of the vehicle, moving the container to an inverted orientation within a spray booth disposed in the vehicle and enclosing the spray booth.

Thereafter, fluid is sprayed on the inside surfaces of the inverted container to clean surfaces and dislodge solids. The dislodged solids are separated from the spray fluid and compacted.

BRIEF DESCRIPTION OF THE DRAWINGS

The present invention will be more clearly understood with reference to the following detailed description, and connection with the appended drawings, in which.

DETAILED DESCRIPTION

With reference to FIGS. 1-4, there is shown a mobile trash container cleaning system 10 in accordance with the present invention which generally includes a vehicle 12 having a spray booth 16 disposed therein along with a movable access door 20 for enclosing the spray booth 16. The vehicle 12 and spray booth 16 along with the door 20 may be of any suitable design.

Figure 1:
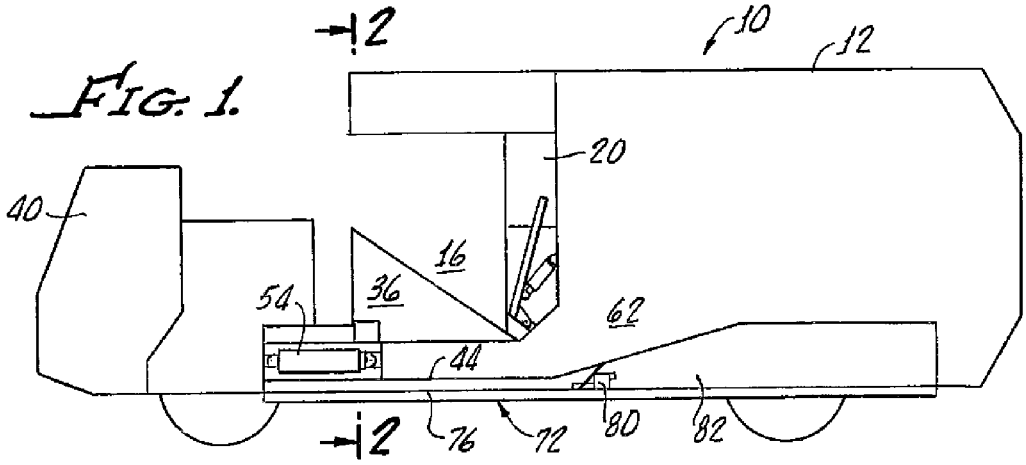
FIG. 1 is a side view of the present invention generally showing a vehicle which is partially broken away to show a stationary platform and a ramp, a movable access door along with a ram packer and movable platform.
Figure 2:
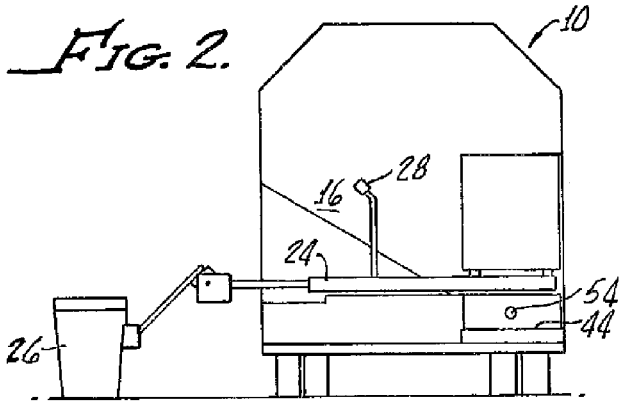
FIG. 2 is a cross sectional view taken along line 2-2 of FIG. 1 and further illustrating a trash container disposed outside the vehicle.
Figure 4:
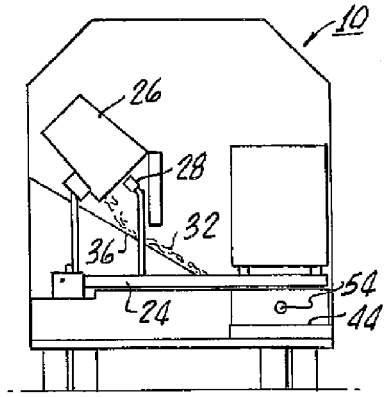
FIG. 4 is a view taken along the line 4-4 of FIG. 3 illustrating the inverted trash container being sprayed with fluid and dislodging solids therefrom which fall down a ramp and onto a platform.
Figure 3:
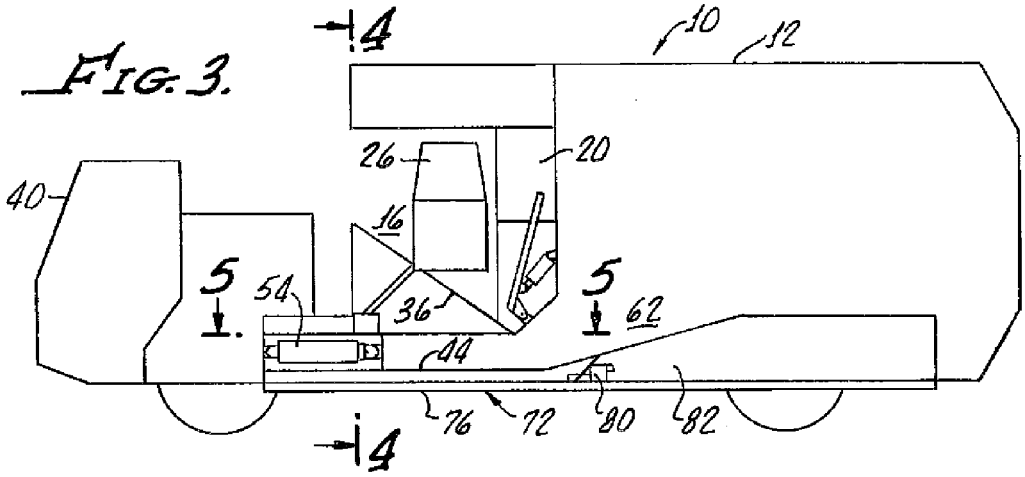
FIG. 3 is a view similar to FIG. 1 illustrating the trash container inverted within a spray booth within the vehicle.
Figure 5:
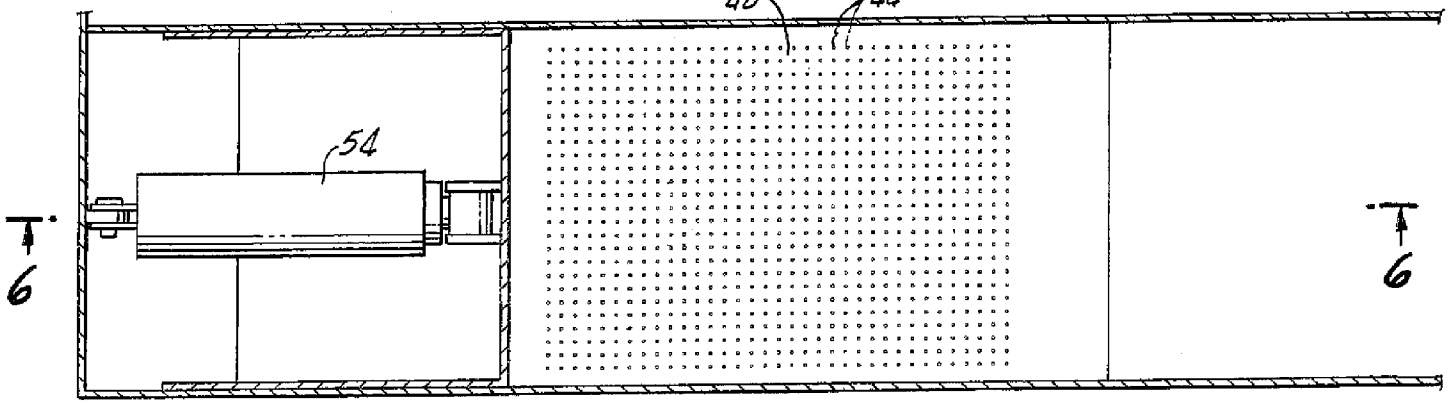
FIG. 5 is a plan view of the platform and ram packer.

With particular reference to FIGS. 2 and 4, the system 10 further includes a manipulating arm 24 for engaging and lifting a container 26 disposed outside of the vehicle 12 and inverting the container 26 inside the spray booth 16 as shown in FIG. 4. Any suitable arm 24 may be utilized.

As best shown in FIG. 4, a sprayer 28, preferably retractable, is provided for spraying fluid onto inside surfaces, not shown, of the inverted container 26, to clean the container 26 and dislodge solids 32 onto a ramp 36. The sprayer 28 may be of a suitable configuration as, for example, as set forth in the U.S. Pat. No. 3,291,144 which is cited herewith as an example only and is not considered to be limiting of the type of movable or retractable sprayer 28 suitable for use of the present invention. Coordination and performing of the method in accordance with the present invention may be conducted from a vehicle cab 40 with conventional controls, therein, not shown.

Figure 6:
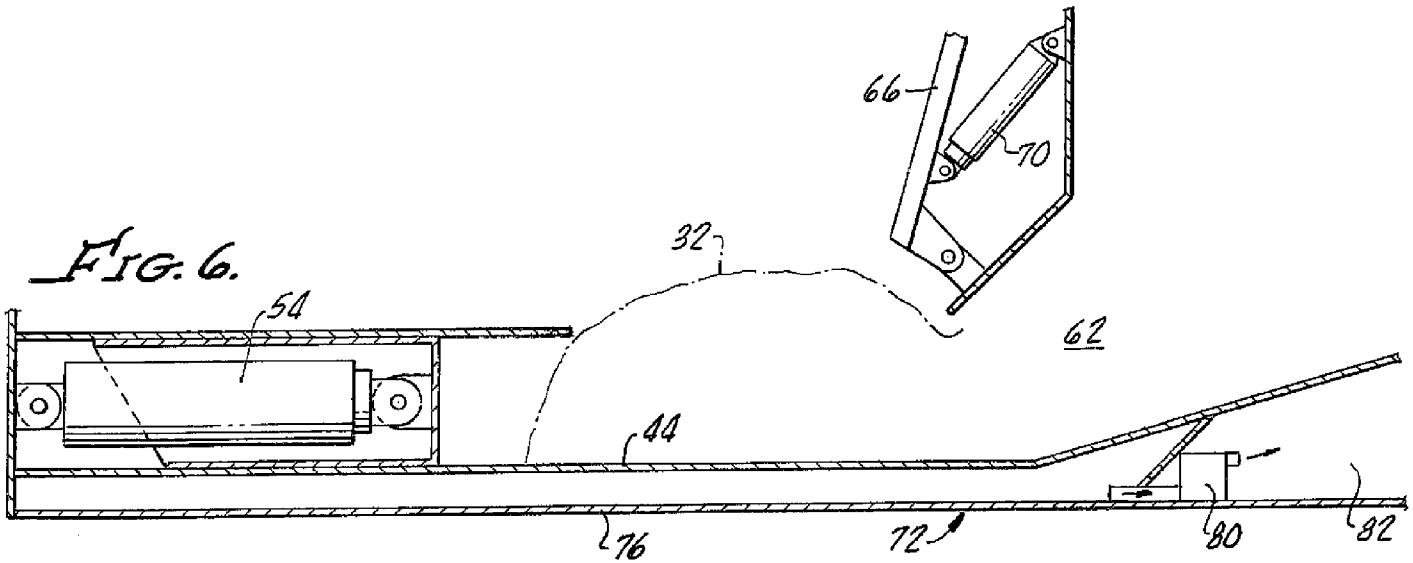
FIG. 6 is a cross sectional view taken along the line 6-6 of FIG. 5 illustrating separation of dislodged solids from fluids through perforations in the platform.
Figure 7:
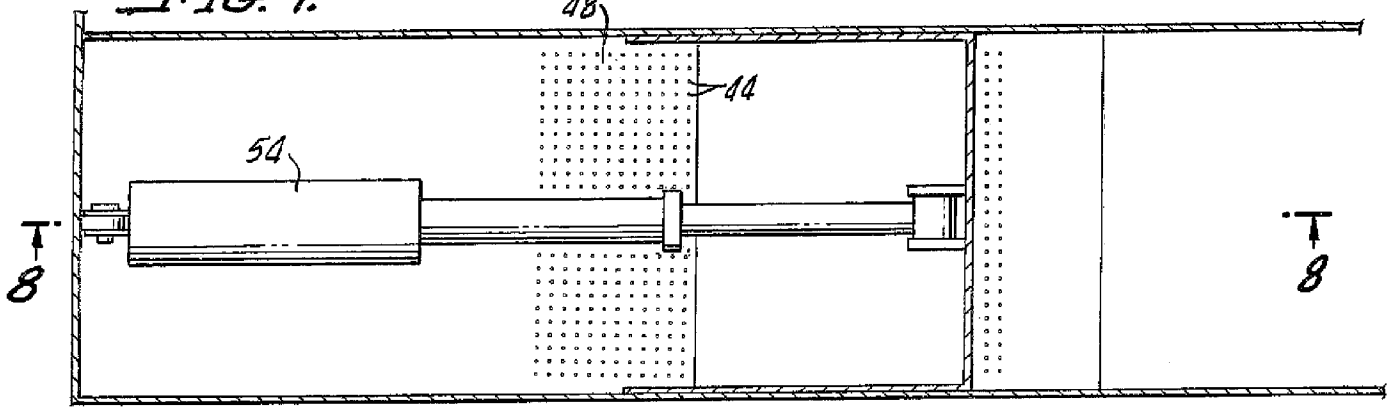
FIG. 7 is another plan view similar to FIG. 5 illustrating operation of the ram packer in compacting and moving dislodged solids from the platform.

A stationary platform 44 shown in FIGS. 1-4, but best shown in FIGS. 5-8 is provided for receiving the dislodged solids 32, shown accumulated in FIG. 6, with the platform 44 having perforations 48 for enabling sprayed fluid to pass therethrough. A ram packer 54 moves the dislodged solids 32 from the platform 44 and into a storage chamber 62 within the vehicle 12.

The ram packer 54 may be of conventional hydraulic design.

Figure 8:
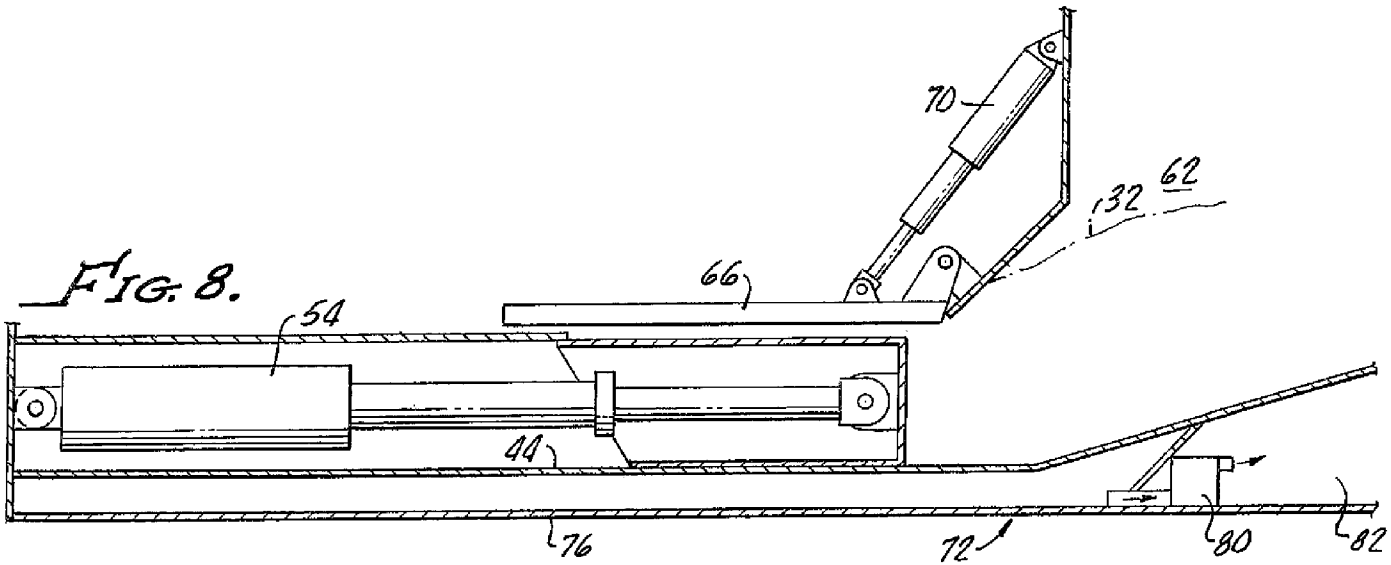
FIG. 8 is a view taken along the line 8-8 of FIG. 7 illustrating a movable panel disposed in a position covering the platform and enabling efficient transfer of the dislodged solids by the ram packer.

As shown in FIGS. 6 and 8, a movable panel 66 is provided for compressing the solids 32 against the platform 44 by way of a hydraulic piston 70 in order to force residual fluids from the dislodged solids 32 and, in addition, covering the stationary platform 44 for facilitating complete evacuation of the solids 32 into the chamber 62, as illustrated in FIG. 8 during operation of the ram packer 54.

Sprayed fluid capturing apparatus including a pan 76 disposed beneath the platform 44 along with a pump 80 and a tank 82 recover the sprayed fluid for separate disposal thereof or recirculation after treatment through the sprayer 28.

The cleaning system 10 facilitates a method in accordance with the present invention of cleaning a trash container which includes picking up the container 26 outside the vehicle 12 and moving the container 26 to an inverted orientation within a spray booth 16 disposed within the vehicle 12, enclosing the spray booth 16 by way of the access door 20 and thereafter spraying fluid onto surfaces of the container 26.

Simultaneously, separating solids from the sprayed fluid and thereafter packing the separated solids completes the method in accordance with the present invention.

Although there has been hereinabove described a specific splint assembly in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A mobile trash container cleaning system comprising:

a vehicle;

a spray booth, disposed on said vehicle;

a movable access door configured for enclosing said spray booth;

a manipulating arm configured for engaging and lifting a container disposed outside of said vehicle and inverting said container inside said spray booth;

a sprayer disposed for spraying a sprayed fluid onto inside surfaces of said container to clean said container and dislodge a plurality of solids;

a flat stationary platform for receiving said plurality of solids washed from said container, said flat stationary platform including perforations enabling the sprayed fluid to pass therethrough;

a hydraulic ram packer for completely moving the plurality of solids from the flat stationary platform into a storage chamber in said vehicle the hydraulic ram packer configured to move in a horizontal direction; and a flat movable panel pivotably connected to said vehicle and pivotable about a horizontal axis for compressing the plurality of solids against the flat stationary platform in order to force a residual fluid from the plurality of solids and through the perforations and also configured for covering both said flat stationary platform and said hydraulic ram packer during a movement of said hydraulic ram packer.

2. The system according to claim 1 further comprising a ramp disposed in said spray booth for directing the dislodged solids and sprayed fluid onto the platform.

3. The system according to claim 2 further comprising a sprayed fluid capturing apparatus disposed, in part, under the flat stationary platform.

4. A method for cleaning a trash container, said method comprising:

picking up said trash container outside of a vehicle;

moving said trash container to an inverted orientation within a spray booth disposed in said vehicle;

enclosing said spray booth;

spraying a sprayed fluid onto inside surface of said trash container;

dislodging and separating a plurality of dislodged solids from said sprayed fluid;

receiving the plurality of dislodged solids on a flat stationary platform;

covering said flat stationary platform with a flat movable panel pivotably connected to said vehicle and pivotable about a horizontal axis; and compressing the plurality of dislodged solids with said flat movable panel in order to force residual fluid form the plurality of dislodged solids; and moving, with a hydraulic ram packer, said plurality of dislodged solids from said covered flat stationary platform into a storage chamber in said vehicle.

5. A mobile trash container cleaning system comprising:

a vehicle;

a spray booth, disposed on said vehicle;

a movable access door for enclosing said spray booth;

a manipulating arm for engaging and lifting a container disposed outside of said vehicle and inverting said container inside said spray booth;

a sprayer disposed for spraying a sprayed fluid onto inside surfaces of said container to clean said container and dislodge a plurality of dislodged solids;

a flat stationary platform for receiving said plurality of dislodged solids washed from said container said flat stationary platform including perforations enabling the sprayed fluid to pass therethrough;

a ram packer for moving said dislodged solids from said stationary platform into a storage chamber in said vehicle, the hydraulic ram packer configured to move in a horizontal direction; and a flat movable panel pivotably connected to said vehicle and pivotable about a horizontal axis configured for compressing the dislodged solids against said stationary platform in order to force residual fluid from said dislodged solids and through the perforations and also configured for covering both said stationary platform and the ram packer for facilitating complete evacuation of said plurality of dislodged solids into said storage chamber.

* * * * *